US006212991B1

(12) United States Patent
Frazier, III

(10) Patent No.: US 6,212,991 B1
(45) Date of Patent: Apr. 10, 2001

(54) RAPID FIRE MECHANISM FOR FIREARMS

(76) Inventor: Taylor Frazier, III, 1332 Lorelei Dr., Fayetteville, OH (US) 45118

( * ) Notice: Subject to any disclaimer, the term of this patent is extended or adjusted under 35 U.S.C. 154(b) by 0 days.

(21) Appl. No.: 09/288,743

(22) Filed: Apr. 8, 1999

(51) Int. Cl.[7] ..... F41A 5/00

(52) U.S. Cl. ..... 89/196; 89/198; 89/163; 42/69.02; 42/69.03; 42/16; 42/22

(58) Field of Search ..... 42/14, 15, 16, 42/17, 22, 69.02, 69.03; 89/163, 196, 198, 199

(56) References Cited

U.S. PATENT DOCUMENTS 5,060,555 * 10/1991 Sater et al. ..... 89/198
5,309,815 * 5/1994 Moller et al. ..... 89/196
5,581,046 * 12/1996 Weldle et al. ..... 89/196
5,654,519 * 8/1997 Albrecht et al. ..... 89/196

* cited by examiner

*Primary Examiner*—J. Woodrow Eldred
(74) *Attorney, Agent, or Firm*—Gary M. Graham; Robert L. Graham

(57) ABSTRACT

The invention provides an apparatus for reducing recoil on a firearm or gun and to increase rate of firing. The invention uses a dual mass system to dynamically balance the gun wherein some of the energy of firing is absorbed within springs and thereby reduces the recoil force imparted to the gun user. The apparatus also comprises an ejector mechanism for ejecting a spent round and reloading a new round from the gun magazine with increased speed over conventional designs. The apparatus is applicable to automatic and semiautomatic handguns as well as rifles and machine guns.

10 Claims, 5 Drawing Sheets

RAPID FIRE MECHANISM FOR FIREARMS

BACKGROUND OF THE INVENTION

This invention relates generally to an improved firearm. In one aspect it relates to a firearm which has reduced recoil action when fired. In another aspect it relates to a firearm which has in increased rate of firing capability.

In what follows the term firearm is intended to refer to both handguns (pistols) and rifles which may be of the semiautomatic or fully automatic type. The term firearm is intended to also comprise fully automatic machine guns. For clarity, the present invention will be described as it relates to applications in semiautomatic handguns. However, the invention may also be adapted to rifles and machine guns.

There are many uses for handguns that include sport, police and military use, and personal self-defense. In the sport known as action or combat shooting, an individual is presented with a series of targets that simulate combat and/or self-defense scenarios. Another type of shooting sport is fixed-target shooting. Police and military personnel also participate in these sports as part of training exercises. In these activities the objective is to hit the target or targets as many times as possible in a given period of time with as high an accuracy as possible. The preferred (and in some sports required by rule) handgun for these activities is of the semiautomatic type wherein each round (bullet) is automatically loaded from a magazine into the gun barrel. However, the trigger must be pulled and released each time the gun is to be fired. In a fully automatic firearm the ammunition is discharged in rapid succession by pulling and holding the trigger only once.

Two important characteristics of semiautomatic handguns are i) minimum recoil, and ii) minimum cycle-time. Other important factors are the gun weight and fire power.

When a gun is fired the explosion of the gunpowder in the ammunition casing or shell creates a forward force on the bullet that propels the bullet out of the gun barrel. Basic physics requires that an equal and opposite force be exerted rearward by the bullet on the gun. This force is referred to as recoil. The portion of the recoil that is sensed by the gun user is referred to as "felt" recoil. The felt recoil is less than the total recoil because automatic and semiautomatic guns contain a spring or springs which absorb some of the energy released when the gun is fired.

Because the gun barrel wherein the recoil force is applied is usually slightly above the wrist of the user, a moment is created about the wrist that tends to rotate the gun barrel upward after firing. In a semiautomatic gun the result is that the gun must be re-aimed before it can be fired again. Excessive recoil can also lead to wrist injury after repeated use. It can be appreciated, therefore, that minimal felt recoil is a desirable attribute for guns since it will reduce the time required to re-aim the gun.

Efforts to reduce felt recoil have resulted in the development of compensators. A compensator is a modification to the gun barrel wherein a small hole is formed in the top of the barrel near the barrel discharge. When the bullet passes the hole a jet of high-pressure gas within the barrel is emitted from the hole. The jet produces a downward force on the end of the gun barrel that counteracts the recoil moment. Compensators have the problem of obscuring the sight of the gun as well as safety problems since the gas jet is hot. Compensators also require a longer barrel that adds weight to the gun.

The cycle-time is the time between successive firings of the gun. In a semiautomatic handgun, for example, the cycle consists of: i) pulling the trigger which fires the bullet, ii) ejection of the empty shell casing from the barrel, and iii) loading of a new round from the magazine (usually in the gun handle) whereby the gun is ready to be fired again. The cycle-time in a semiautomatic handgun is usually faster than the ability of the user to re-aim the gun and fire again. Therefore, the limiting factor in the firing rate is the proficiency of the user.

In a fully automatic gun, such as a machine gun, the limiting factor in the cycle-time is primarily the speed at which the empty shell casing is ejected from the gun and the speed at which a new round can be loaded from the magazine into firing position. The ejection process is controlled by an ejector mechanism that is automatically activated when the gun is fired. The ejector is activated by the gun slide which is a spring-loaded member that is driven rearward by the impact of the explosion of the ammunition. During the rearward motion of the slide, the ejector is activated and ejects the empty shell casing from the gun. Under the action of the slide spring, the slide is first halted and then driven forward returning it to the firing position. At the rear-most position of the slide the magazine is opened and a new round is forced upward (from the magazine in the handle of the gun) into the gun bolt. During the forward motion, the slide rams the round forward into the gun barrel whereby the gun is ready to be fired. The duration of the motion of the slide therefore defines the cycle-time of the gun.

The speed of the slide is primarily a function of its mass. In conventional designs, the force exerted by the gun frame on the slide by for halting its rearward motion is the primary source of felt recoil. In many designs the slide will actually impact upon the frame during the rearward stroke and create a large felt recoil force.

SUMMARY OF THE INVENTION

The present invention is predicated on a semiautomatic or fully automatic gun that reduces felt recoil and significantly reduces the cycle-time. The improvement is achieved by a novel dynamic balancing mechanism that isolates the gun slide from the frame (handle) when the gun is fired and thereby reduces felt recoil. The mechanism also ejects the spent shell casing and brings the gun to battery (reloads) more rapidly than conventional designs thereby reducing cycle-time and increasing the maximum firing rate (i.e. shots per minute).

The dynamic balancing is achieved by replacing the conventional single mass slide with a dual mass slide and "bolt" combination. The relative motions of the slide and bolt are timed in a way that isolates the slide from the frame whereby the slide does not impact (collide) with the gun frame and, therefore, does not impart a large felt recoil to the hand of the user. The slide and bolt are slidingly coupled and both are free to move rearward (towards the gun handle) and forward relative to each other. The slide and bolt are coupled with a spring (referred to as the bolt spring). The movement of the bolt relative to the slide is limited by forward and rearward stops on the slide. As in the conventional design the slide is slidingly coupled to the frame of the gun with a second spring (referred to as the slide spring) interposed therebetween. Although the ranges will vary from gun to gun, the bolt will typically have one-fourth to one-half the mass of the slide.

The felt recoil is reduced by timing the motion of the bolt relative to the slide whereby some of the recoil force induced by the explosion of the ammunition is absorbed within the itself thereby balancing the gun and reducing felt recoil. Whereas in conventional designs comprising a single mass slide wherein the slide impacts the gun frame imparting a large felt recoil force thereto, in the present design the slide and bolt are isolated from the frame and thus never impact the frame thereby reducing recoil. The bolt and frame are slidingly coupled to the frame in the forward and rearward directions and the term "isolated" refers to isolation in the direction of recoil force (i.e. rearward towards the gun handle).

In the present invention, the explosion of the ammunition initiates the rearward motion of both the slide and the bolt. However, because the bolt is lighter it moves rearward much faster than the slide. The masses of the slide and bolt (as well as the bolt and slide spring stiffnesses) are sized to optimize the timing of these motions so that:

i) the bolt moves rearward much faster than the slide and collides with the slide before the slide has undergone significant movement whereby the rearward motion of the bolt is halted (neither part has contacted the frame, i.e . both are isolated from the frame), ii) the bolt now moves forward as the slide continues to move rearward so that the forward bolt momentum cancels some of the slide rear-ward momentum, iii) the bolt impacts the slide and halts the slide rearward movement before the slide collides with the frame whereby the slide does not impart an impact force on the frame (as inconventional designs), and iv) both the bolt and the slide move forward together and return to the firing position at the same time whereby the gun is ready to be fired again.

The collisions described in i) and iii), can be regarded as "internal" collisions since they occur between the bolt and slide only, which are isolated from the frame (in the manner described in the preferred embodiments below).

Whereas in the conventional design the force of the explosion is exerted on a single mass slide, in the present dual mass system the force is exerted on the much lighter bolt. Under this force the bolt is driven rearward much faster than the conventional single mass slide design. During the rearward stroke the bolt activates the ejector and extracts the empty shell. At its rear-most position, the bolt opens the magazine for admitting a new round into the gun which is rammed into the barrel by the forward motion of the bolt and the gun is ready to be fired again. The forward motion is induced by the bolt spring which is brought into compression during the rearward stroke. Thus the rearward and forward motions of the bolt define the cycle-time of the gun. Because the bolt has significantly less mass than the slide of the conventional design, the cycle-time is significantly reduced.

The following sequence of events summarize the cycle of the gun. The rearward motions described being induced by the rearward reaction of the exploding ammunition, and the forward motions described being induced by the bolt and slide springs.

1. the gun is fired and the bolt and slide begin to move rearward with bolt moving much faster than the slide
2. the bolt activates ejector and ejects spent shell
3. the bolt internally collides with the slide which halts the bolt rearward motion before either the bolt or slide collide with the frame
4. near rear-most position the bolt opens the magazine and admits new round into the gun, the slide continues to move rearward
5. the bolt moves forward while slide moves rearward thereby canceling some of the slide momentum and absorbing much of the energy of the explosion and reducing felt recoil
6. the bolt internally collides again with the slide and halts the slide rearward motion before the slide collides with the frame, the bolt and slide begin to move forward together
7. during forward motion, the bolt rams a new round into firing position in the gun barrel
8. the bolt and slide return to firing position In a semiautomatic gun, events 1 through 8 would occur each time the trigger is pulled, and the limiting factor in the rate of firing (shots per minute) is the speed at which the user can re-aim the gun. The mechanical speed of the cycle is generally much faster than human factor of re-aiming and the proficiency of the user determines the firing rate.

In a fully automatic gun, events 1 through 8 would repeat continuously for as long as the trigger is pulled and held, thus, the firing rate is determined by the mechanical speed of the gun. Experimental tests described below indicate that the present dual mass system significantly increases firing rate.

From the forgoing it can be appreciated that the present design accomplishes the objectives of i) reducing felt recoil by isolating the slide from the frame by timing the relative movements of the bolt and slide, and ii) reducing cycle-time by speeding the ejection and reloading process.

DESCRIPTION OF THE PREFERRED EMBODIMENTS

The present balancing mechanism will be described as applied to a semiautomatic handgun. However, it will be appreciated by those of skill in the art that the invention may be applied to fully automatic guns as well. The term gun is intended to include semiautomatic and fully automatic handguns, rifles, and machine guns.

The overall structure of the gun will first be described followed by a description of the balancing mechanism and the principles of operation. Preferred embodiments of the firing mechanism and ejector mechanisms will be described. However, these may be any number of the those practiced in the art and, therefore, are not intended to limit the scope of the invention which is directed at a timed dual mass system for reducing felt recoil and increasing firing rate.

Handgun Components

Figure 1:
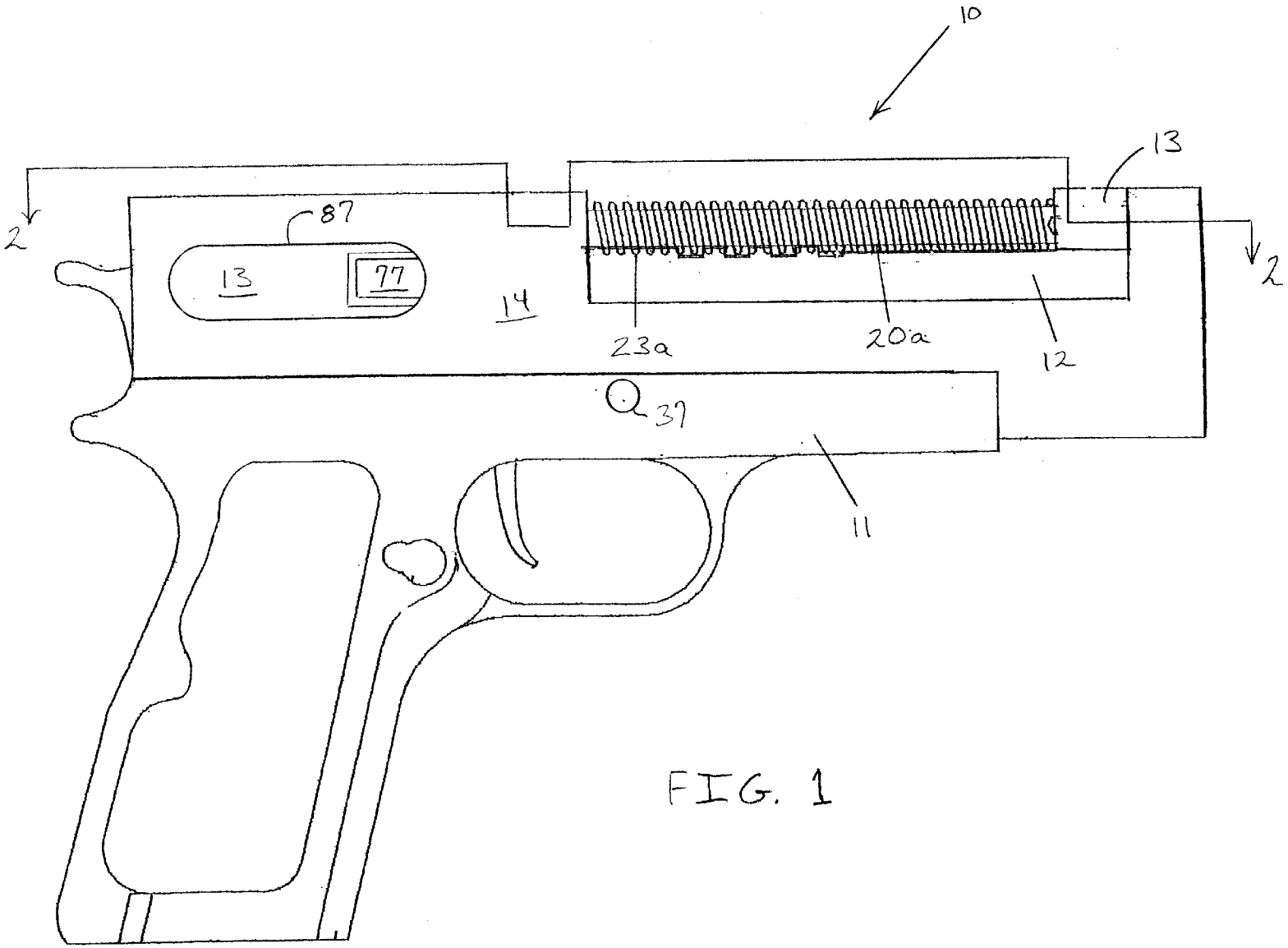
FIG. 1 is a side view of the present invention as embodied in a semiautomatic handgun.
Figure 2:
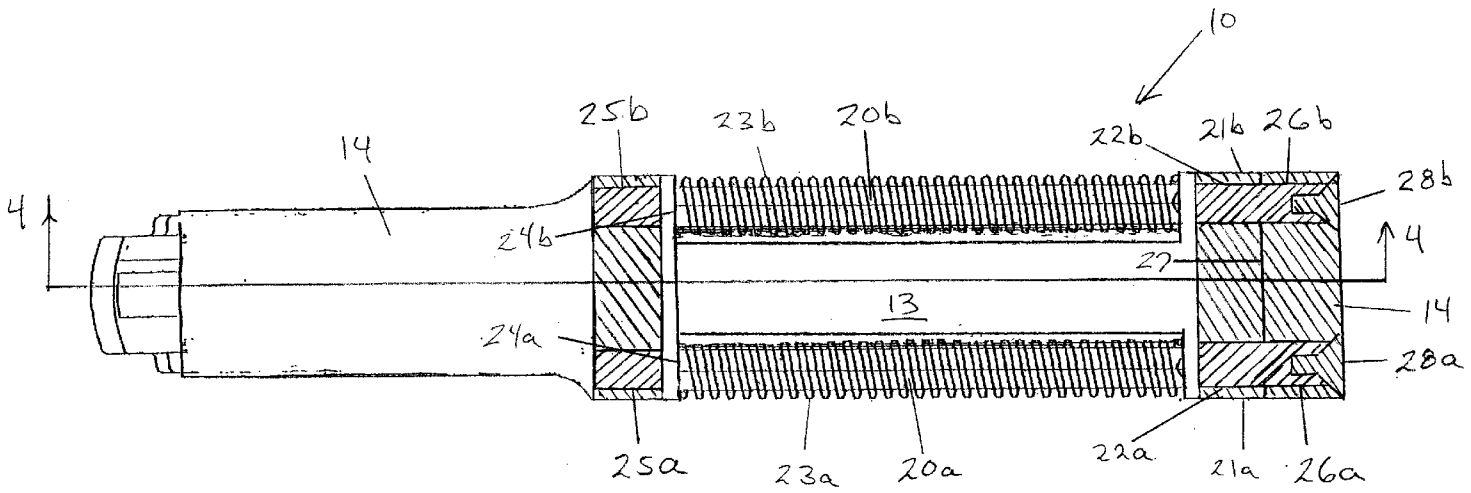
FIG. 2 is a top partial sectional view taken along section 2—2 in FIG. 4.
Figure 3:
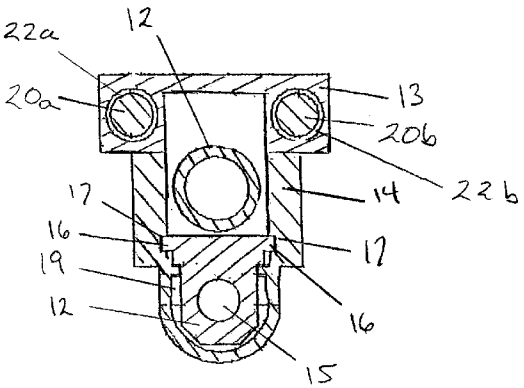
FIG. 3 is a sectional frontal view taken along plane 3—3 of FIG. 4.

As seen in FIGS. 1 through 4, semiautomatic handgun 10 comprises the components of frame 11, barrel 12, bolt 13, and slide 14. As best seen in FIG. 3, frame 11 has race 16 which mates with groove 17 of slide 14 for slidingly securing the slide to the frame. Frame 11 has secured thereto rod 15 (see FIG. 4) which has compression spring 18 disposed around the rod at one end and in contact with slide 14 at the opposite end. The slide has hole 19 wherein slide spring 18 is inserted. Spring 18 limits the rearward motion of the slide with respect to the frame when the gun is fired as described later. Barrel 12 and bolt 13 are slidingly disposed within slide 14.

As best seen in FIG. 2, slide 14 has two rods 20*a* and 20*b* which act as guide rods for the sliding motion of bolt 13 relative to the slide. The rods are secured to slide 14 in holes 25*a* and 25*b* at one end and holes 26*a* and 26*b* at the other end. The rods are held in place by flathead machine screws 28*a* and 28*b* which are threaded into the ends of the rods. Bolt 13 has projections 21*a* and 21*b* with holes 22*a* and 22*b*, respectfully drilled therethrough. Rods 20*a* and 20*b* pass slidingly through the holes for guiding the bolt motion as will be described. Bolt springs 23*a* and 23*b* (see FIG. 2) are compression springs which are in contact with slide 14 at 24*a* and 24*b* on the backside of the springs and in contact with the bolt projections at 21*a* and 21*b* at the front of the springs. The bolt springs are always in compression and therefore exert a forward force on the bolt with respect to the slide. In the firing position (i.e. before the gun is fired) the bolt is held in compression against the slide at interface 27. The rear portion of bolt 13 is of rectangular cross section. The rear portion of slide 14 has a rectangular cavity which is open at both ends in which the bolt may slide uninhibited forward and backward. The sliding motion of the bolt with respect to the slide is limited in the forward direction by projects 21*a* and 21*b* contacting the slide at interface 27, and in the rearward direction with springs 23*a* and 23*b* in full compression whereby the springs bottom-out.

Barrel 12 has circular front end 31 which passes slidingly through barrel hole 32 in slide 14 for securing the barrel to the slide. The rear of barrel 12 is of square cross section and fits slidingly into a square cavity (see FIG. 3) formed in the center of bolt 13 in front of bolt surface 33 (see FIG. 4) for support and aligning the rear of the barrel with respect to the bolt and the slide.

Figure 4:
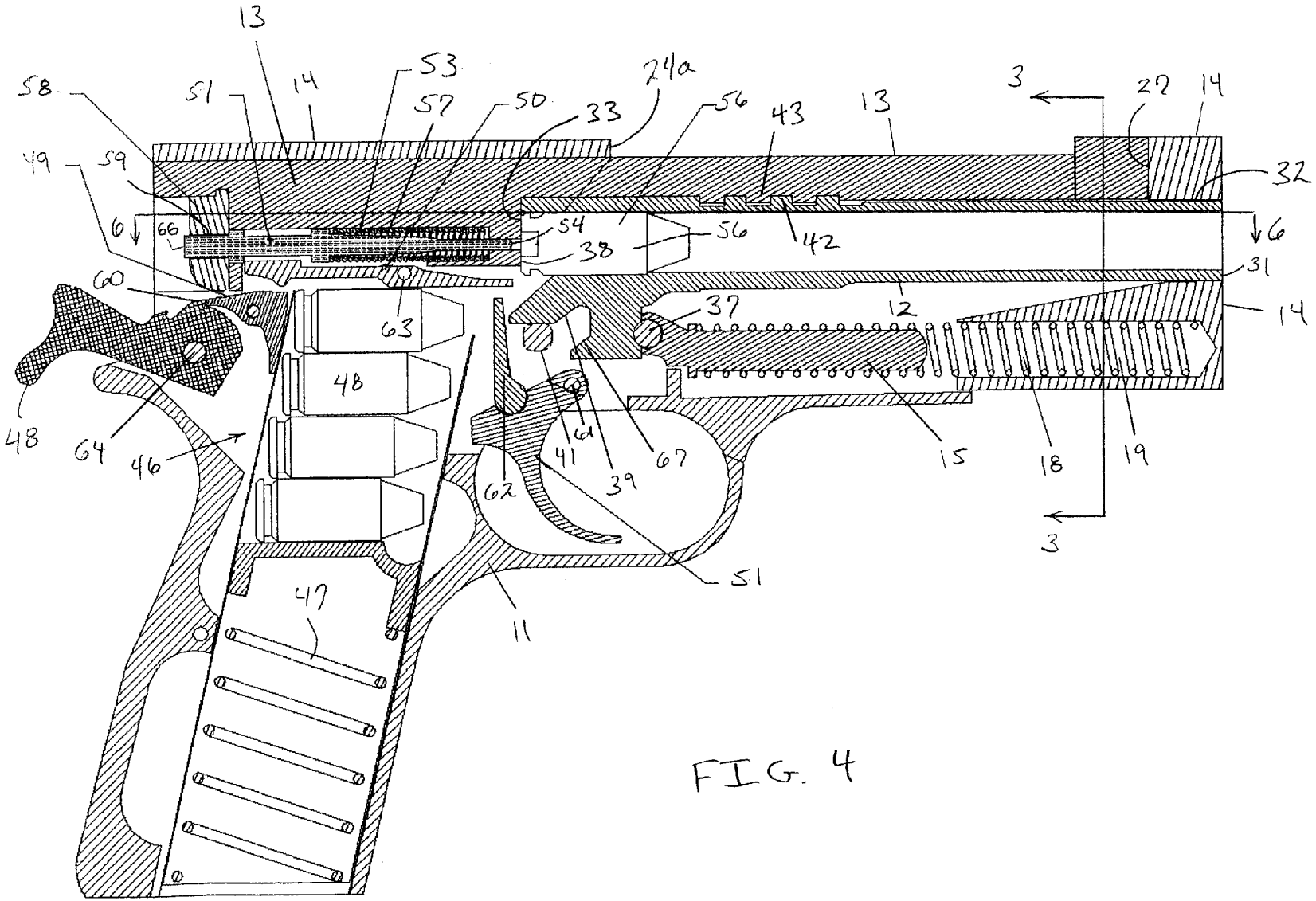
FIG. 4 is a side sectional view taken along plane 4—4 in FIG. 2 showing the gun in the firing position.

The components comprising the barrel 12, bolt 13, and slide 14 will each move with respect to frame 11 and with respect to each other when the gun is fired as described below. However, each component is slidingly secured to the frame as follows. Referring to FIG. 4, spring 18 exerts a forward force on slide 14 with respect to frame 11. The slide motion with respect to the frame is guided by race 16 and grooves 17 as has been described. Bolt springs 23*a* and 23*b* are very stiff compression springs and tend to hold bolt 13 against slide 14 as illustrated at interface 27. The bolt springs exert a forward force on the bolt with respect to the slide and an equal and opposite rearward force on the slide with respect to the bolt due to contact with the slide at 24*a,b*. Thus the slide/bolt combination is induced to move forward under the action of slide spring 18. The forward motion of bolt 13 is limited by barrel 12 and pin 37 (referred to as the slide release pin) which is secured to frame 11. Bolt 13 exerts a forward force at the rear of barrel 12 at barrel breech 38. Barrel 12 has cam 39 with follower pin 41 which is secured to frame 11. The forward force on the barrel forces the rear of the barrel upward on the cam which acts to hold barrel lugs 42 and bolt lugs 43 in engagement. The forward motion of the barrel is limited by pin 37 secured to frame 11, which in turn limits the forward motion of the bolt/slide combination due to contact at breech 38 and lugs 42 and 43 as shown in FIG. 4.

Gun 10 further comprises firing mechanism comprising hammer 48, sear 49, sear lever 50, trigger 51, and firing pin 52 disposed slidingly in hole 53 in the rear portion of bolt 13. End 54 of pin 52 is disposed away from round 56 in the breech of the barrel by compression spring 57. Stop 58 is secured to the rear of bolt 13 and limits the rearward movement of the firing pin which may slide in hole 59 of the block. In the cocked position, hammer 48 is pulled rearward and held in position by sear 49 which pivots downward about pin 64 to engage pawl 60 of the hammer. The firing mechanism is activated be pulling trigger 51 rearward which causes the rear of the trigger to rotate upward about pin 61 whereby trigger lever 62 contacts the forward end of sear lever 50. The forward end of the lever is pushed upward causing the back part of the lever to rotate about pin 63 downward and contact the front of sear 49. Sear 49 pivots upward and becomes disengaged from hammer pawl 60 whereby the hammer is released to strike end 66 of the firing pin. Hammer 48 and frame 11 have a torsional spring (not shown) interposed therebetween which induces the hammer into the firing position when the hammer is released. With hammer 48 cocked (as shown in FIG. 3), end 66 of the firing pin protrudes slightly out of stop 58. When the gun is fired hammer 48 is released and will strike end 666 and the momentum imparted to the pin will force pin end 54 into the rear of round 56 thereby detonating the primer in the round. The firing mechanism used in the present invention may be any of the conventional types used in the art. The above description of the firing mechanism is by way of illustration only and is not intended to limit the scope of the present invention which is predicated on a firearm with reduced recoil and cycle-time.

Handgun 10 also comprises magazine 46 having spring 47 and ammunition (rounds) 48. Spring 47 exerts an upward force on the ammunition and automatically loads the gun as will be described.

Balancing of Handgun

The firing of the handgun and the interaction between the slide, the bolt, the barrel and the frame whereby the gun is balanced and cycle-time reduced will be described. The sequence of events over one cycle of firing will be described in relation to FIGS. 4 and 5*a* through 5*f*. It should be noted that the mass of slide 14 is preferably between 2.5 to 5 times and most preferably between 3.5 to 4.5 times that of bolt 13 so that more force is required to move the slide than the bolt. Note also that part of the firing mechanism has been omitted from FIGS. 5*a* through 5*f* for clarity.

Figure 5:
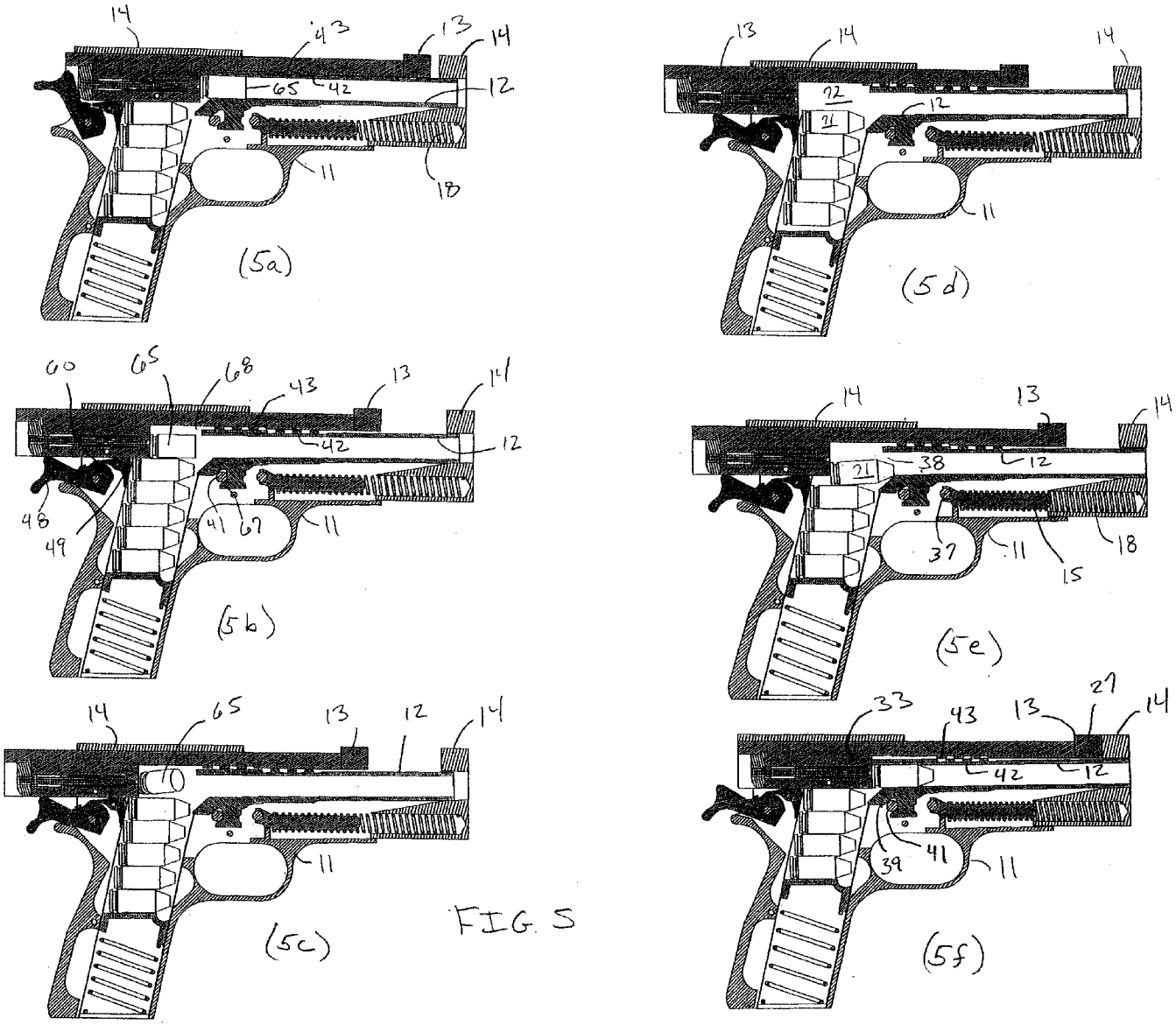
FIGS. 5*a* through 5*f* are side sectional views showing the relative movements or the gun components over one cycle after the gun is fired.

In FIG. 4 the gun is fired and the explosion of the ammunition exerts a rearward force on the bolt 13 at surface 33 which causes the bolt to move rearward as illustrated in FIG. 5*a*. Lugs 42 and 43 remain engaged and barrel 12 moves rearward with the bolt. Because the bolt and barrel are free to slide with respect to slide 14, and the slide is significantly heavier, the slide stays essentially stationary over the short time interval from FIGS. 4 to 5*a*. The round has left the barrel leaving spent shell casing 65 which moves rearward with the bolt.

As seen in FIGS. 5*a* and 5*b*, barrel 12 has upward facing cam 67 (see FIG. 4) which contacts the bottom of pin 41 and forces the rear of the barrel downward as it moves rearward. The motion of the barrel is halted with the rear of the barrel hung on pin 41 as shown in FIG. 5*b*. The collision of the barrel with pin 37 (which is secured to frame 11) creates only a small amount of felt recoil because the mass of the barrel is small. The downward motion uncouples lugs 42 and 43 and bolt 13 continues to move backward while barrel 12 is stationary and hung on pin 41. The uncoupling of the bolt and barrel serves two purposes. First, it creates an opening between the bolt and the barrel wherein the spent shell casing may be ejects and a new round loaded into the barrel from the magazine. Secondly, it creates an opening 68 around the outside of the barrel whereby some of the exhaust gas from the explosion may be released whereby the pressure in the barrel rapidly drops. This improves the safety of the gun. Because the slide is significantly heavier than the bolt, the slide stays essentially stationary during the interval from FIGS. 5*a* to 5*b*. Thus all of the energy imparted to the gun from firing the gun has been transferred to the bolt with some of the energy stored in springs 23*a* and 23*b* which are being compressed as the bolt moves rearwards with respect to the slide. Note also in FIGS. 5*a* and 5*b* that the rearward motion of the bolt has forced hammer 48 back whereby sear 51 engages hammer pawl 60 to re-cock the gun.

As illustrated in FIG. 5*c*, the continued rearward motion of the bolt activates the ejector mechanism (described below) which ejects the empty shell casing 65 out of the side of the gun. Continued bolt rearward motion shown in FIG. 5*d* opens the magazine and spring 47 forces new round 71 into space 72 created between bolt 13 and barrel 12.

In FIG. 5*d*, bolt 13 is at its rear most position and subsequently under the action of springs 23*a* and 23*b* begins to move forward once round 71 is in position. At this point, springs 23*a* and 23*b* have bottomed-out against slide 14 at 24*a* and 24*b*. and the rearward motion of bolt 13 is halted by colliding with slide 14. However, slide 14 has only just begun to move rearward on race 16 due to forces exerted by springs 23*a,b* (as well as the bolt collision) and, therefore, neither the slide nor the bolt have collided with frame 11. Thus in FIG. 5*d*, bolt 13 has begun to move forward and slide 14 has begun to move rearward.

In FIG. 5*e*, bolt 13 is moving forward while slide 14 is simultaneously moving rearward. Round 71 is pushed into the breech 38 of stationary barrel 12 by the forward motion of bolt 13. The simultaneous forward momentum of the motion counteracts the rearward momentum of the slide and is the key to balancing the gun and reducing recoil as discussed in more detail below.

FIG. 5*f* illustrates the instant the bolt and slide contact each other at interface 27. The collision in combination with force exerted by spring 18 halts the rearward slide motion. At this instant the slide is at its rear most position and subsequently due to the forward force exerted on the slide by spring 18 the slide begins to move forward. Slide spring 18, however, has not bottomed-out and therefore there is no impact force exerted on frame 11 (via rod 15 and pin 37 which secured to the frame). Springs 23*a* and 23*b* hold bolt 13 in compression against the slide and the slide/bolt combination moves forward together. The bolt also collides with the breech of barrel 12 at surface 33 (see FIG. 4) and begins to push the barrel forward (note that the collision is isolated from the frame. The rear portion of the barrel rides upward on cam 39 and pin 41 whereby lugs 42 and 43 are engaged. The slide, bolt, and barrel move forward together and the gun returns to the firing position illustrated in FIG. 4.

The important principles underlying the operation of the present balancing mechanism whereby felt recoil is reduced are summarized as follows:

1. When bolt 13 moves rearward and collides with slide 14 (i.e. intermediate bolt springs 23*a,b* bottom-out), the slide has not yet appreciably moved and, therefore, spring 18 has not been compressed from the firing position and the slide is free to move on race 16. Thus the collision is substantially internal to the gun and no impact force is exerted on frame 11. This is in contrast to conventional handguns wherein the slide and bolt (i.e. joined in a single mass which slides on race 16) are integral and the rearward motion is halted when spring 18 bottoms out and an impact force is imparted to frame 11 causing a significant recoil to be imparted to the hand and wrist of the user.
2. The bolt/slide collision halts the bolt movement and the bolt begins to move forward while the slide simultaneously begins to moves rearward due to the collision and the forces exerted by springs 23*a,b* at surfaces 24*a,b*. The forward bolt momentum cancels (balances) some of the rearward momentum of the slide and thereby reduces the recoil force. The effect is predictable using Newton's second law which states that the force on a system is equal to the time rate of change of the momentum of the system as a whole (in this case the entire gun is the system). It is true that the rearward motion of the heavier slide will create some net rearward momentum and therefore some felt recoil force. However, while the bolt moves forward and the slide moves rearward, the net momentum of the gun as a whole is reduced thereby reducing the force on the hand of the user.
3. The forward moving bolt collides with the rearward moving slide at interface 27. The collision halts the rearward motion of the slide and at this position spring 18 has not been fully compressed and, therefore, no impact force is exerted on the frame. The collision may be thought of as being internal to the gun and creates very little external force on the user's hand.
4. The bolt/slide combination moves very rapidly in the forward direction to return the gun to the firing position.

From items 1 through 3 above, it can be seen that at no point during the cycle (except at the very end of the cycle when the slide/bolt/barrel combination impacts pin 37 which not important as related to felt recoil) does the bolt or slide impart an impact-type force of the frame. Thus, the bolt and slide are always isolated from the frame after firing.

Ejector Mechanism

Figure 6:
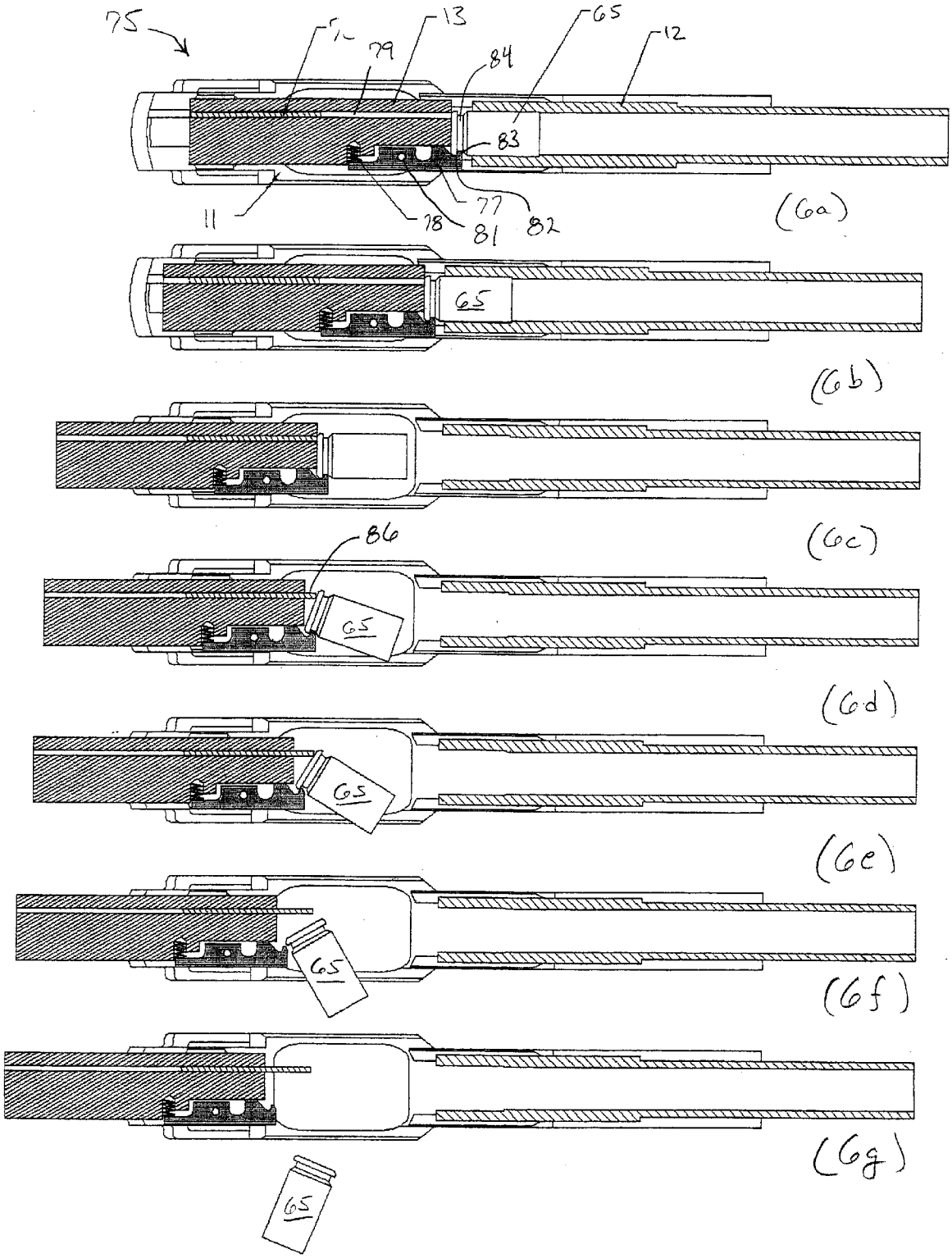
FIG. 6 is a top sectional view taken along plane 6—6 in FIG. 4 illustrating the ejector mechanism.

Referring to FIG. 6*a*, ejector mechanism 75 comprises ejector plate 76, extractor 77, and extractor spring 78. Ejector 76 is secured to frame 11 and slidingly disposed in slot 79 formed in bolt 13. Ejector 76 is eccentrically mounted with bolt 13 and is stationary with respect to the bolt. Extractor 77 is pivotally mounted to bolt 13 on pin 81. At the forward end extractor 77 has clip 82 which engages has rounded frontal edge 83 which detachably engages with groove 84 formed around the rear end on casing 65. Spring 78 is a compression spring and exerts an outward force on the rear of extractor 77 which acts to keep clip 82 engaged with groove 84, so that when the gun is fired, bolt 13 and casing 65 move rearward together. As shown in FIGS. 6*b* and 6*c*.

At the instant illustrated in FIG. 6*c* the rear casing 65 has contacted the front of ejector 76. Continued rearward movement of bolt 13 exposes end 86 of the ejector which imparts an outward ejection force (or moment) on casing 65 which acts to rotate the casing about clip 82 as shown in FIGS. 6*d* and 6*e*. The force is imparted in a direction to eject the casing out the side of the gun through slot 87 formed in the side of slide 14 (see FIG. 1). In FIGS. 6*f* and 6*g* the casing has released from clip 82 and is ejecting from the gun. Spring-loaded pivotal member 77 facilitates the release of the casing from the clip.

Following the ejection of casing 65, bolt 13 moves rearward and opens magazine 56 for injecting a new round of ammunition into firing position as has been described in relation to FIGS. 5*d* and 5*e*. As the new round 71 moves into space 72, bolt 13 reverses direction and begins to move forward and push round 71 into breech 38 of barrel 12. During this process the round resists slightly the motion whereby rounded frontal edge 83 of clip 82 slides (as extractor 77 pivots on pin 81) around the outer rim of the groove round the rear of shell 71 to engage the shell for the next ejection cycle. Spring 78 holds the ejector and casing 71 in engagement as the gun is brought to battery (i.e. into the firing position).

The present invention contemplates the use of any compatible ejector system known in the art and the above description is by way of illustration only and is not intended to limit the scope of the present invention.

EXAMPLE

A semiautomatic handgun as exemplified in the description and figures described above has been constructed and tested. A conventional handle, firing mechanism and ejector system (as described above) were employed.

The testing was carried out to demonstrate the efficacy of the present invention as embodied in a semiautomatic handgun. However, it will be appreciated by those of skill in the art that the invention may be equally applied to fully automatic guns including rifles and machine guns and, therefore, the description of the embodiments below are not intended to limit the invention to only semiautomatic handguns.

A .40 caliber semiautomatic hand gun was constructed having the following properties:

| | Slide (14) | Bolt (13) | Barrel (12) | Frame (11) |
|---|---|---|---|---|
| Preferred Mass (lb) | 0.365 | 0.981 | 0.260 | 1.433 |
| Most Preferred Mass(lb) | 0.150 | 0.600 | 0.260 | 1.433 |
| Preferred Material | 4340 Stainless | Titanium | Steel | Aluminum Alloy |

| | Slide Spring Stiffness | Bolt Spring Stiffness |
|---|---|---|
| Preferred (lb/in) | 9.50 | 19.0 |
| Most Preferred (lb/in) | 6.29 | 25.0 |

The above data are illustrative of the ranges for a semiautomatic handgun of the size constructed. It will be understood by those in the art that these data will be scaled upward or downward in accordance with size of the handgun, rifle, or machine gun.

Video taped tests have been carried out on the semiautomatic handgun. A vise-grip mount (simulating a human wrist) for supporting the gun handle and means for pulling the gun trigger were constructed so that the gun could be remotely fired and video taped. A Redlake Motion Scope 500 with a film rate of 500 frames/second and a shutter speed of 1/10,000 of a second was used to record the motion of the gun components after firing. The description of the motion as depicted in FIGS. 5*a* through 5*f* are based on the results of these recordings.

Based upon these data the cycle-time has been found to be between 0.05 and 0.067 seconds. A time range being given as it was not possible to accurately synchronize the impact of the hammer and the end of the cycle with the resolution (in frames per second) of the camera and therefore it was not possible to precisely determine the beginning and end of the cycle. Multiple tests were, however, conducted and these data represent the range of the results. It was possible, however, to accurately record the relative motion of the bolt and slide over the cycle.

The cycle-time data have been used to compute the rate of fire (rounds per minute) that the present invention would yield when applied to a fully automatic gun. The calculation is given by:

$$\text{Rounds per minute}=(1/CT)\times 60=895 \text{ rounds/minute}$$

Where CT=cycle time=0.067 seconds

The above rate can be compared to a conventional fully automatic handgun which typically has a rate of 600 rounds/minute.

The high speed photograph tests also revealed a significant decrease in muzzle rise after firing the present handgun.

What is claimed:

1. A gun, comprising:

(a) a frame, (b) a slide member slideably mounted on the frame and having a first compression spring interposed between the slide and the frame to urge the slide forward, (c) a bolt member slideably mounted on the slide between a forward and rearward positions and including a second compression spring interposed between the bolt and the slide urging the bolt and the slide apart, (d) a barrel slideably mounted on the slide and including engaging means to secure the barrel and bolt together to slide as a unit, and disengaging means to permit the bolt to slide independent of the barrel, said disengaging means being operated attendant to reward movement of the unit at a predetermined disengaging position on the frame, (e) means for inserting a cartridge in the barrel, (f) means for firing the cartridge whereby firing of the gun causes the slideable slide, bolt, and barrel to slideably move from a forward home position through a firing cycle in the following sequence:

(i) initially the bolt and barrel slide rearward along the slide from the forward position to the disengaging position, compressing the second spring, and disengaging the barrel which remains stationary with respect to the frame, (ii) the bolt continues to move rearwardly along the slide to the rearward position further compressing the second spring and impacting on the slide, causing (iii) the slide to move slidingly rearward along the frame compressing the first spring; and (iv) the slide and bolt move forward to the engaging position and the bolt and barrel engage; and (v) finally, the first and second springs slidingly return the slide, bolt, and barrel to the home position.

2. The gun of claim 1 wherein the gun is a semiautomatic handgun wherein the firing cycle repeats each time the trigger is pulled.

3. The gun of claim 1 wherein the gun is a fully automatic gun wherein the firing cycle repeats for as long as the trigger is pulled.

4. The gun of claim 3 wherein the firing cycle is greater than 800 rounds per minute.

5. A gun, comprising:

(a) a frame having a slide pin secured thereto, (b) a slide member slideably attached to the frame and having a slide spring interposed therebetween, (c) a bolt member having a mass less than the mass of the slide, and slideably secured to the slide, and having a bolt spring interposed therebetween, (d) a barrel detacheably secured to the bolt and having
- i) a forward cylindrical end and in the firing position having a round of ammunition disposed therein
- ii) a rearward breech which contacts the bolt in the firing position, and
- iii) means for engaging the slide pin (e) a firing mechanism for detonating the ammunition whereby
- i) a rearward force is imparted to the bolt at the barrel breech
- ii) the bolt and barrel move rearward
- iii) the barrel engages the slide pin and disengages from the bolt and the barrel is stationary while the bolt continues slidingly rearward following the disengagement
- iv) a rearward force is imparted to the slide by the bolt spring causing the slide to move slidingly rearward and compressing the slide spring which imparts a forward force on the slide
- v) the bolt impacts the slide and begins to move forward while the slide continues to move rearward thereby balancing the gun
- vi) the bolt engages the barrel and the bolt and barrel move slidingly forward as a unit
- vii) the slide moves slidingly forward under the action of the slide spring, and
- viii) finally, the slide, bolt, and barrel return to the firing position.

6. The gun of claim 5 wherein the gun is a semiautomatic handgun wherein the firing cycle repeats each time the trigger is pulled.

7. The gun of claim 5 wherein the gun is a fully automatic gun wherein the firing cycle repeats for as long as the trigger is pulled.

8. The gun of claim 5 wherein the firing cycle is greater than 800 rounds per minute.

9. The gun of claim 5 further comprising an ejector mechanism for ejecting the spent casing of the ammunition, said ejector being activated by the rearward motion of the bolt.

10. The gun of claim 9 further comprising a automatic loading mechanism comprising a spring-loaded magazine, said spring forcing a new round of ammunition from the magazine into the bolt at or near the rearward most position of the bolt and whereby the round is forced into the barrel breach at or near the bolt and barrel engaging position during the forward motion of the bolt.

* * * * *